United States Patent [19]

Balinski

[11] Patent Number: 4,621,470

[45] Date of Patent: Nov. 11, 1986

[54] RUNNER AND AREA SEPARATION WALL STRUCTURE UTILIZING RUNNER

[75] Inventor: Henry A. Balinski, Hoffman Estates, Ill.

[73] Assignee: United States Gypsum Company, Chicago, Ill.

[21] Appl. No.: 595,626

[22] Filed: Apr. 2, 1984

[51] Int. Cl.[4] ..... E04B 2/84

[52] U.S. Cl. ..... 52/241; 52/303

[58] Field of Search ..... 52/547, 209, 242, 241, 52/238.1, 239, 303

[56] References Cited

U.S. PATENT DOCUMENTS

| | | | |
|---|---|---|---|
| 1,803,589 | 5/1931 | Bohnsack | 52/241 |
| 1,924,986 | 8/1933 | Frazier | 52/241 |
| 2,038,115 | 4/1936 | Keller | 52/241 |
| 2,909,251 | 10/1959 | Nelsson | 52/238.1 |
| 2,915,149 | 12/1959 | Dreyfus | 52/241 |
| 3,184,801 | 5/1965 | Fletcher | 52/209 |
| 4,327,528 | 5/1982 | Fritz | 52/533 |

FOREIGN PATENT DOCUMENTS

| | | | |
|---|---|---|---|
| 973324 | 8/1975 | Canada | 52/241 |
| 1200497 | 12/1959 | France | 52/209 |
| 2426142 | 5/1978 | France | 52/209 |
| 329647 | 6/1958 | Switzerland | 52/243.1 |
| 199307 | 6/1923 | United Kingdom | 50/209 |

*Primary Examiner*—John E. Murtagh

*Attorney, Agent, or Firm*—Samuel Kurlandsky; Robert M. Didrick; Robert H. Robinson

[57] ABSTRACT

An integral generally channel-form runner for securing and supporting one or more wallboard panels in a demountable structure, the runner having an integral platform for supporting the lower edges of the wallboard panels in a position spaced above the bottom of the runner to prevent absorption of water and formation of mildew at the edges of the wallboard panels.

3 Claims, 4 Drawing Figures

RUNNER AND AREA SEPARATION WALL STRUCTURE UTILIZING RUNNER

BACKGROUND OF THE INVENTION

1. Field of the Invention

The present invention relates to building construction, and more particularly concerns runners to support parallel spaced-apart wallboards in a position wherein their lower edges are spaced above the bottom of the runner to prevent water absorption and mildew.

2. Description of the Prior Art

In the assembly of wall panels to construct a wall, and particularly an area separation wall, it is conventional to provide elongate channel members, called runners for retaining the edges of the panels. The runners are secured to the floor and ceiling, thereby fixing the position of the wall with respect thereto. Such runners may have a variety of shapes, but more generally have a channel-form shape, and invariably require an inner panel supporting surface for each panel. In the construction of area separation walls two rows of wallboard are required. The runners may be manufactured in a variety of ways and form a variety of materials. One of the least expensive fabrication means is to roll-form metal strips into the desired channel shape.

Area separation walls are typically installed prior to complete enclosure of the building. The wallboard panels are therefore exposed to all the common elements. During a rain water collects in the runner track and at low spots on the concrete floor. This water is absorbed at the edges of the gypsum liner panels, eventually causing delamination of the paper and the formation of mildew.

SUMMARY OF THE INVENTION

It is an object of the invention to provide a runner for securing and supporting a wall formed of a plurality of wall panels such as gypsum wallboard panels or other wall panels such as cement board panels.

It is a further object of the invention to provide a runner having an integral platform for supporting the lower edges of panels such as gypsum wallboard panels above the lower portion of the lower runner to prevent the panels from absorbing water and forming mildew.

It is still further an object of the invention to provide a structure of the type described which is inexpensive and relatively easy to fabricate and assemble.

Other objects of the invention will become apparent from reference to the following description and accompanying drawings.

According to the invention, a runner is provided having a supporting the upper edges of the flanges of the runner, the clip having a supporting platform spaced above the bottom of the runner for supporting the lower edges of gypsum wallboard panels to prevent their being immersed in water which may collect at the bottom of the runner, thereby preventing the deterioration of the paper cover sheets due to water absorption and preventing the formation of mildew.

DESCRIPTION OF THE PREFERRED EMBODIMENTS

Figure 1:
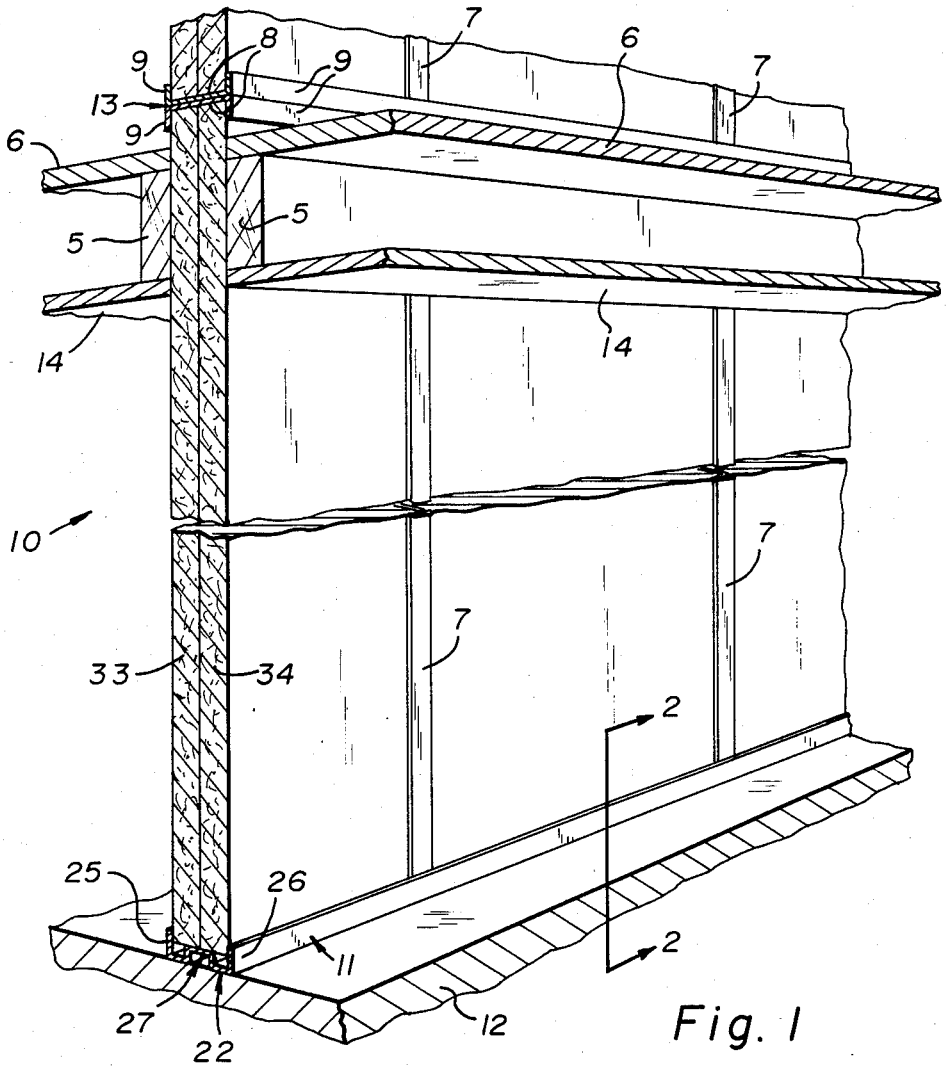
FIG. 1 is a perspective view of an area separation wall according to the invention.
Figure 2:
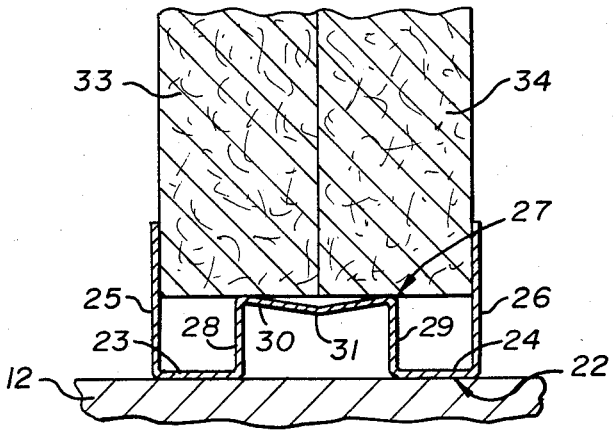
FIG. 2 is a cross-sectional view taken at the line 2—2 of FIG. 1, looking in the direction of the arrows.

Referring to FIGS. 1 and 2, an area separation wall structure 10 is shown comprising a lower runner 11 mounted on a floor 12 and an upper runner 13 comprising runner members mounted back-to-back. A ceiling 14 is mounted on joists 5, and an upper floor 6 is also supported on the joists. The upper runner 13 comprises webs 8 and flanges 9.

Figure 3:
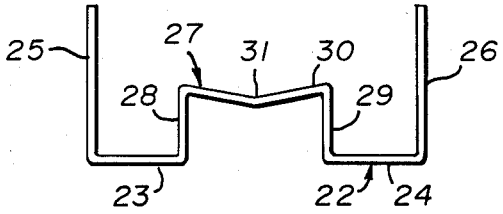
FIG. 3 is an end view of the runner according to the invention.
Figure 4:
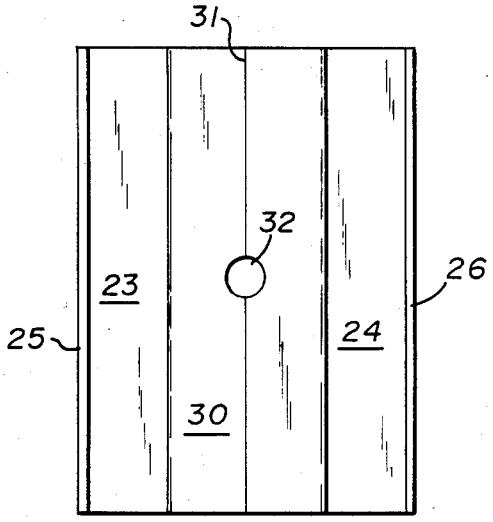
FIG. 4 is a top view of the runner shown in FIG. 3.

Referring to FIGS. 2, 3, and 4, a lower runner structure 11 according to the present invention is illustrated, comprising a lower web 22 formed of a web members 23 and 24. Extending from the edges of the web members 23 and 24 are outer flanges 25 and 26, respectively. Connecting the lower web members 23 and 24 is a channel 27 formed of inner flange members 28 and 29 extending from the edges of the lower web members 23 and 24. The channel 27 is completed by a platform web 30 extending from and connecting the edges of the inner flanges 28 and 29. The platform web 30 is provided with a depression 31 for collecting any water present thereon, and an aperture 32 is provided in the platform web for permitting any water present to be drained from the platform web.

As shown in FIGS. 1 and 2, gypsum wallboard panels 33 and 34 are supported on the platform web 30 of the runner 11 and spaced above the bottom or web member 23 and 24 of the lower runner 11. The edges of the wallboard panels 33 and 34 are retained by studs 7. The upper edges of the wallboard panels 33 and 34 are retained within the channel of the upper runner 13. The aperture 32 provided in the platform web 30 of the runner 11 permits drainage of water which might collect on the surface of the platform web.

In assembling the area separation wall 10 of the present invention, the lower runner 11 is first affixed to the floor. Gypsum wallboard panels 33 and 34 are then set into the channel of the runner and supported by the platform web 30 of the runner 11 with the edges of the panels 33 and 34 spaced above the web members 23 and 24 of the lower runner 11. The upper runner 13 is mounted over the upper edges of the panels.

During the construction of a building, when the outer walls have not been completely constructed, water tends to get into the interior of the building. Some water generally passes into the channel of the runners. If the edges of the panels rest in the water, water is absorbed in the paper cover sheets, leading to deterioration and mildew formation. However, since the edges of the panels are maintained at a distance above the web members of the runner by the elevated platform web 30 of the invention, water does not come in contact with the panels and consequently does not seep into the panels, which condition might cause the stated problems.

The structure of the present invention offers a number of advantages. First, the runner structure requires no additional mounting steps. The platform web structure maintains the panels spaced above the bottom of the runner and consequently keeps the panel edges out of contact with any collected water. As a result, the panels do not deteriorate and are not subject to the formation of mildew. The runner is very inexpensive and easy to fabricate.

While the present invention has been disclosed in the light of specific embodiments thereof, it is evident that many alternatives, modifications, and variations may be readily apparent to one skilled in the art in the light of the foregoing disclosure as contained in the specification and drawings. Accordingly, the disclosure is intended to embrace all such alternatives, modifications and variations as may fall within the spirit and scope of the invention as defined in the following appended claims.

I claim:

1. A wall structure comprising in combination:

1. an integral substantially U-shaped runner comprising:
   (a) a pair of web members having flanges extending from the outer edges thereof and substantially perpendicular thereto,
   (b) an inverted channel comprising a pair of inner flanges one extending from the inner edge of each of said web members, and
   (c) a platform web connected at each edge to an edge of one of said inner flanges, said platform web being spaced at a distance above each of said web members, the center of said platform web being depressed for draining water from the upper surface of said platform web,
2. a gypsum wallboard panel having its entire lower edge positioned in said runner and supported by said platform web in spaced-apart relationship above both of said web members, and
3. A U-shaped channel mounted over and supporting the upper edge of said gypsum wallboard panel whereby, said platform web supports the lower edge of said gypsum wallboard panel at a distance elevated above said web members sufficient to prevent water which may be present in said runner from contacting the edge of said panel.

2. A wall panel according to claim 1, wherein an aperture is provided in said platform web to permit water to drain therefrom.

3. A wall structure according to claim 1, wherein a plurality of gypsum wallboard panels have their entire lower edges positioned in said runners.

* * * * *